US008732884B1

(12) United States Patent
Woslager

(10) Patent No.: US 8,732,884 B1
(45) Date of Patent: May 27, 2014

(54) APPARATUS FOR DRESSING A WELD ADJACENT TO A WELD BEAD

(71) Applicant: James Lee Woslager, Adel, GA (US)

(72) Inventor: James Lee Woslager, Adel, GA (US)

( * ) Notice: Subject to any disclaimer, the term of this patent is extended or adjusted under 35 U.S.C. 154(b) by 0 days.

(21) Appl. No.: 13/648,618

(22) Filed: Oct. 10, 2012

Related U.S. Application Data

(60) Provisional application No. 61/689,891, filed on Aug. 6, 2012.

(51) Int. Cl.
*A46B 13/02* (2006.01)

(52) U.S. Cl.
USPC ..... 15/23; 15/179; 15/181

(58) Field of Classification Search
USPC ..... 15/23, 52.1, 179, 181, 21.1, 77, 88.3; 29/81.01, 81.12, 81.17; 451/103, 109, 451/344, 358, 465, 466
See application file for complete search history.

(56) References Cited

U.S. PATENT DOCUMENTS

| | | | | | |
|---|---|---|---|---|---|
| 190,120 | A | * | 5/1877 | Budd | 15/181 |
| 599,044 | A | * | 2/1898 | Pain | 15/181 |
| 885,500 | A | * | 4/1908 | Martin | 15/23 |
| 1,279,996 | A | * | 9/1918 | Dorland | 15/26 |
| 1,374,181 | A | * | 4/1921 | Bohlman | 15/23 |
| 1,927,566 | A | * | 9/1933 | Hawk | 15/23 |
| 1,975,567 | A | * | 10/1934 | Dossmann | 15/179 |
| 2,124,114 | A | * | 7/1938 | L Hommedieu | 15/230.1 |
| 2,253,609 | A | * | 8/1941 | Byron et al. | 15/53.2 |
| 2,613,383 | A | * | 10/1952 | Rousseau | 15/181 |
| 2,645,802 | A | * | 7/1953 | Mundo | 15/181 |
| 4,882,880 | A | * | 11/1989 | Schaffner et al. | 451/490 |
| 5,319,824 | A | | 6/1994 | Cook | |
| 5,412,829 | A | | 5/1995 | Hefner | |
| 6,076,221 | A | | 6/2000 | Bradshaw | |
| 7,210,188 | B1 | | 5/2007 | Kirby | |
| 2006/0080798 | A1 | * | 4/2006 | Kim | 15/179 |

FOREIGN PATENT DOCUMENTS

EP 0152622 A2 8/1985

* cited by examiner

*Primary Examiner* — Mark Spisich
*Assistant Examiner* — Andrew A Horton
(74) *Attorney, Agent, or Firm* — Egbert Law Offices, PLLC

(57) ABSTRACT

An apparatus for dressing a weld in an area adjacent a weld bead has a power head, a shaft affixed to the power head such that the power head rotates the shaft, a first brush affixed to the shaft and extending radially outwardly therefrom, and a second brush affixed to the shaft and extending radially outwardly therefrom. The second brush is spaced by a distance greater than a width of the weld bead from the first brush. Each of the brushes is a wire brush. A third brush can be affixed to the shaft in side-by-side relation to the second brush on a side of the second brush opposite the first brush.

18 Claims, 4 Drawing Sheets

APPARATUS FOR DRESSING A WELD ADJACENT TO A WELD BEAD

CROSS-REFERENCE TO RELATED APPLICATIONS

The present application claims priority from U.S. Provisional Patent Application Ser. No. 61/689,891, filed on Aug. 6, 2012, and entitled "Weld and X-Ray Tech Cleaning Brush, Pipe and Metal Prep Brush".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to multiple brushes. In particular, the present invention the relates to a weld and pipe buffing brush having multiple brushes which can be used in a usual method of buffing completed welds within the pipeline industry. The present invention also relates to wire brushes as mounted on the shaft of a power tool.

2. Description of Related Art Including Information Disclosed Under 37 CFR 1.97 and 37 CFR 1.98

In the pipeline industry, joints of steel pipe are welded together with the aid of several sophisticated tools and skilled welders. Following the completion of welding two joints of steel pipe together, the weld must be examined and often subjected to X-ray evaluation. Additionally, each welded joint is inspected by an experienced technician. Prior to the final visual inspection, each welded joint must be completely buffed and cleaned of all debris. This process is known as "dressing" the weld. The area adjacent to the newly-welded joint is so clean that the base metal of the pipe is thoroughly cleaned and the base metal is clearly revealed. The cleaned area varies from a few inches to several inches in length on both sides of the welded joint. Usually, the area that is cleaned is the same in length on each end of the two joints of pipes that have been welded together. After being thoroughly cleaned, the joint is ready for inspection. After the acceptance of the weld has been obtained, the cleaned joint can then be coated appropriately by whatever means and procedures which have been specified for the specific job so as to make the joint ready for placing the completed joint in the trench for covering with the appropriate backfill.

It is clear that a great deal of time and effort go into cleaning the weld on the joint as well as the area adjacent to the new joint. The current state of the art is to use right-angle grinders equipped with buffer brushes specified for the particular job. Each grinder is equipped with a single grinder/buffer wheel. The worker assigned to clean the weld and the adjacent area spends a significant amount of time on this task. A common practice is to assign two workers to the same joint, one positioned on each side of the pipe to be cleaned. Additionally, one worker often starts at the top of the pipe and the other starts at the bottom of the pipe. This arrangement allows each to work unimpeded by the other. When each reaches a cleaned section of the pipe, the other will know that the pipe has been completely encircled with the cleaning operation.

In past, various patents have issued relating to multiple brush arrangements. For example, U.S. Pat. No. 5,319,824, issued on Jun. 14, 1994 to E. E. Cook, describes a tile joint brush structure that is provided with a handle that can be used from a standing position and pivotable about a horizontal axis to two oblique extremes at which positive stops are provided. The brush structure includes a main brush for cleaning one band of the joint and a laterally adjustably spaced auxiliary brush for simultaneously cleaning an adjoining band of the joint.

U.S. Pat. No. 5,412,829, issued on May 9, 1995 to E. L. Hefner, discloses a tile grout scrubber that is used to scrub adjacent parallel grout lines on a tile floor simultaneously. A long handle is attached to a base that is wider than the space between adjacent grout lines. Two or more long narrow scrubbing elements are adjustably mounted on the base with the long sides parallel to one another. The scrubbing elements are spaced apart to correspond to the spacing between tiles and locked in position. When they are moved back and forth in a scrubbing motion, they tend to remain in the depressed grout lines so they are self-guiding.

U.S. Pat. No. 6,076,221, issued on Jun. 20, 2000 to R. J. Bradshaw, provides an adjustable brush for cleaning grout. This adjustable brush includes a group of brush mounting constructions slidably disposed on a rigid support track. Each mounting construction is movable, yet selectively held in place along the longitudinal axis of the support track. A brush assembly is removably attached to each brush mounting construction. Each brush assembly includes bristles secured within a bristle holding member.

U.S. Pat. No. 7,210,188, issued on May 1, 2007 to M. E. Kirby, discloses a sponge for cleaning grout that occupies the concave spaces between tiles. This sponge has a cleaning surface that includes a plurality of rows of elongate convexities. The convexities are linear in construction and disposed in parallel relation to one another.

European Patent No. 0 152 622, granted on Dec. 22, 1984 to Keller et al., discloses a power tool having a shaft extending therefrom. A single brush element is mounted on the shaft so as to move in relation to the shaft.

It is an object of the present invention to provide an apparatus that simplifies weld dressing and buffing.

It is another object of the present invention to provide an apparatus that reduces the time required to properly dress and clean the weld.

It is a further object of the present invention to provide an apparatus which improves the quality of the weld dressing.

It is another object of the present invention to provide an apparatus that improves the ability to inspect, x-ray, coat, and paint the weld surface.

It is a still another object of the present invention to provide an apparatus for dressing a weld adjacent to a weld bead that is relatively inexpensive, easy to use and easy to manufacture.

These and other objects and advantages of the present invention will become apparent from a reading of the attached specification and appended claims.

BRIEF SUMMARY OF THE INVENTION

The present invention is an apparatus for dressing a weld in an area adjacent a weld bead. The apparatus comprises a power head, a shaft affixed to the power head such that the power head rotates the shaft, a first brush affixed to the shaft and extending radially outwardly therefrom, and a second brush affixed to the shaft and extending radially outwardly therefrom. The second brush is spaced by a distance greater than a width of the weld bead from the first brush.

In the present invention, each of the first and second brushes is a wire brush. Each of the first and second brushes has a core with a hole extending therethrough. The shaft extends through the holes. The wire brushes extend radially outwardly of the core.

A third brush can be affixed to the shaft in side-by-side relation to the second brush on a side of the second brush opposite the first brush. Each of the first and second brushes has a substantially equal outer diameter.

The power head includes a housing, a motor positioned in the housing, and a shaft receptacle drivingly connected to the motor. The shaft is releasably received by the shaft receptacle. A shroud is affixed to the housing and extends outwardly over the first and second brushes. The shroud has a generally semi-cylindrical shape.

In the present invention, the shaft includes a rod having a threaded exterior surface, a coupler threadedly affixed over the exterior surface of the rod, a first nut assembly threadedly affixed over the exterior surface of the rod such that the first brush is interposed between the coupler and the first nut assembly, and a second nut assembly threadedly affixed over the exterior surface of the rod. The coupler extend for less than a length of the rod. The first nut assembly is positioned in the space between the first and second brushes. The second nut assembly is positioned on a side of the second brush opposite the first nut assembly. Each of the first and second brushes has a core. The coupler and the first nut assembly bear against the core of the first brush. The first nut assembly bears against the core of the second brush. The first nut assembly includes a first nut bearing against the core of the first brush and a second nut bearing against the core of the second brush. The second nut assembly includes a third nut bearing against the core of the second brush on a side opposite the second nut. A third brush can be positioned on the rod in a location adjacent to the second brush on a side opposite the first brush. The first nut assembly bears against the second brush. The second nut assembly bears against the third brush. The coupler is affixed to the power head.

The present invention is also a brush assembly for dressing a weld in an area adjacent a weld bead. The brush assembly includes a shaft, a first brush affixed to the shaft and extending radially outwardly therefrom, and a second brush affixed to the shaft and extending radially outwardly therefrom. The second brush is spaced by a distance greater than a width of the weld bead from the first brush.

Each of first and second brushes is a wire brush. A third brush can be affixed to the shaft in side-by-side relationship to the second brush on a side of the second brush opposite the first brush. Each of the first brush and the second brush and the third brush have a substantially equal width and a substantially equal diameter. Each of the first, second and third brushes has a core with a hole extending therethrough. The shaft extends through the holes. The wire brushes extend radially outwardly of the core.

The foregoing section is intended to describe, with particularity, the preferred embodiments of the present invention. It is understood that modifications to this preferred embodiments can be made within the scope of the present invention. As such, this section should not to be construed as limiting, in any way, of the broad scope of the present invention. The present invention should only be limited by the following claims and their legal equivalents.

DETAILED DESCRIPTION OF THE INVENTION

Figure 1:
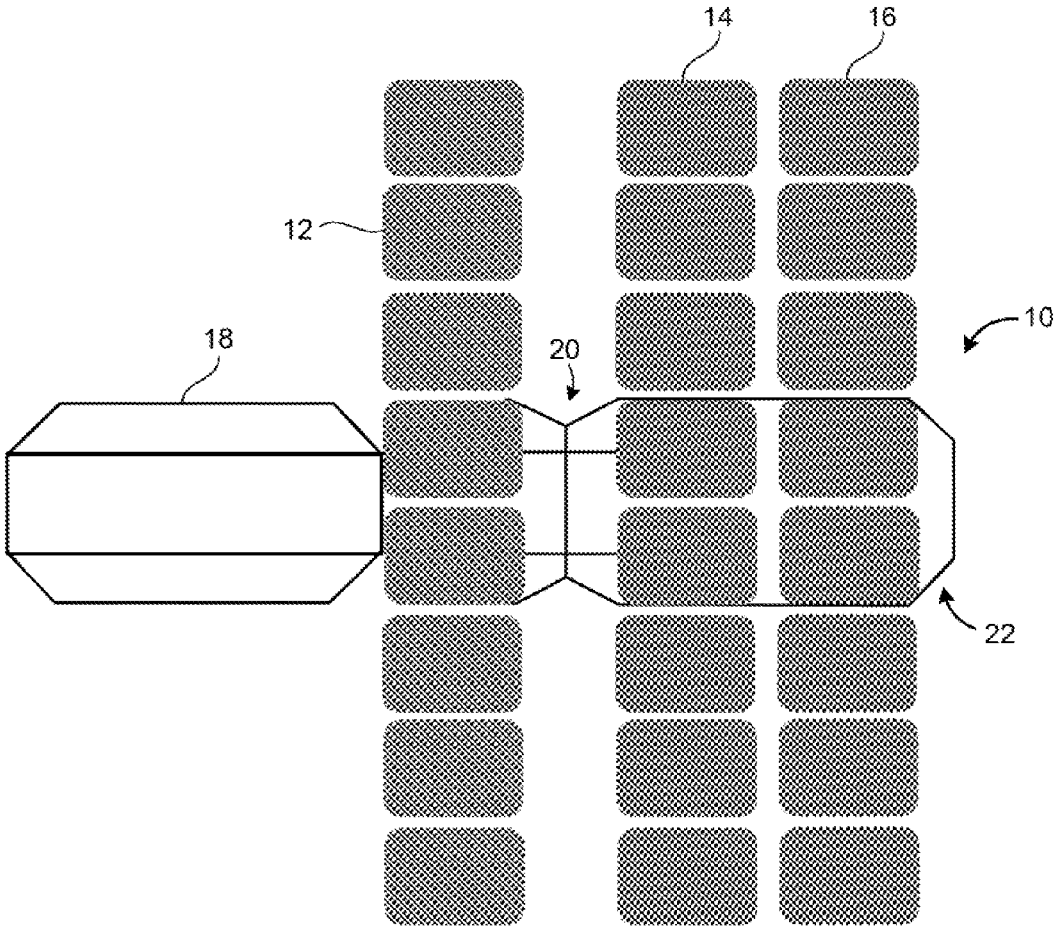
FIG. 1 is a side elevational view of the brush assembly in accordance with the teachings of the present invention.

Referring to FIG. 1, there is shown the brush assembly 10 as used for a dressing in a weld in an area adjacent to a weld bead. The brush assembly 10 includes a shaft (not shown), a first brush 12 and a second brush 14 mounted on the shaft. A third brush 16 can also be mounted in side-by-side relationship to the second brush 14 on a side opposite the first brush 12. As such, as the shaft rotates, the brushes 12, 14 and 16 will correspondingly rotate so as to clean and dress the area adjacent to the weld bead. The first brush 12 is separated from the second brush 14 by a space having a width approximately equal or greater than the width of the weld bead.

A coupler 18 will be affixed onto an end of the shaft. Coupler 18 allows the shaft, and the associated brushes 12, 14 and 16, to be mounted on a shaft of a power head of a power tool. A first nut assembly 20 is positioned on the shaft in the space between the first brush 12 and the second brush 14. A second nut assembly 22 is located on the side of the third brush 16 opposite the second brush 14.

Figure 2:
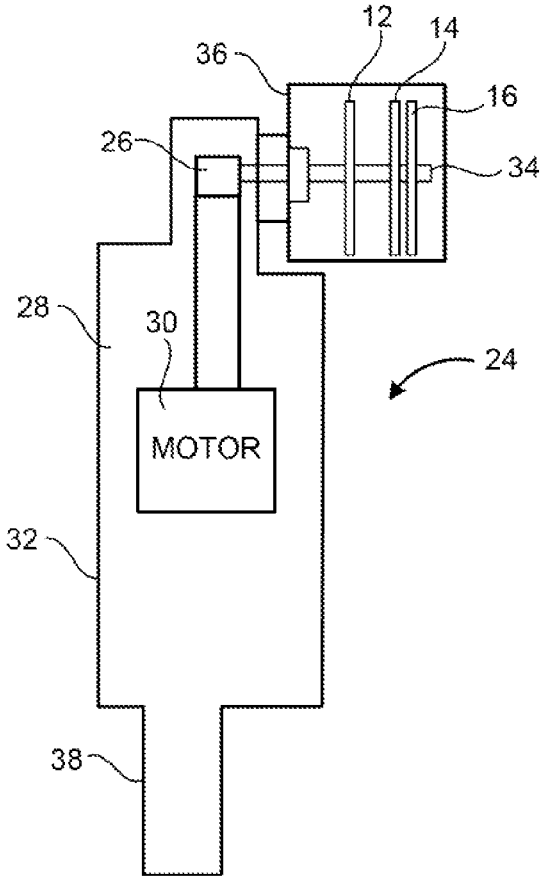
FIG. 2 is a diagrammatic illustration of the apparatus for dressing a weld in accordance with the preferred embodiment of the present invention.

FIG. 2 shows the apparatus 24 of the present invention. The apparatus 24 includes a power head 26 that is part of a power tool 28. The power tool 28 can be in the nature of a hand-held right-angle grinder. A motor 30 is positioned within the housing 32 of the power tool 28. The motor 30 is drivingly connected to the power head 26 so as to cause the power head 26 to rotate the shaft 34. The shaft 34 is illustrated as having the first brush 12, the second brush 14 and the third brush 16 mounted thereover. A shroud 36 will extend over a portion of the brushes 12, 14 and 16 and will extend outwardly from the power head 26 of the power tool 28. The housing 32 also includes a handle 38 located at an end of the power tool 28 opposite the power head 26. As such, the housing 32 of the power tool 28 can be easily held and manipulated by the worker so as to properly dress the weld in the area adjacent to the weld bead.

Figure 3:
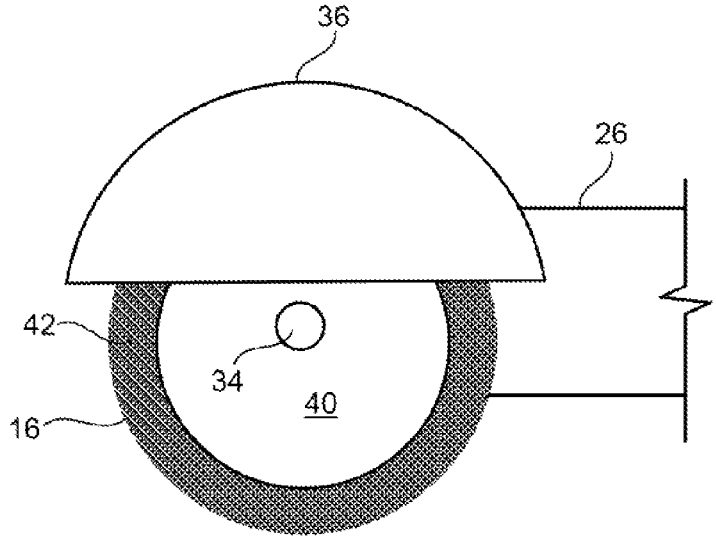
FIG. 3 is an isolated side elevational view showing the relationship of the brush assembly as received within a shroud of the power head of the apparatus of the present invention.

FIG. 3 shows that the shroud 36 has a generally semi-cylindrical configuration. The third brush 16 is illustrated as having a core 40 that is mounted onto the shaft 34. The wire brushes 42 will extend radially outwardly of the core. The shroud 36 is affixed to the power head 26 of the power tool 28. The shroud 36 will cover a portion of the outer diameter of the brush 16 so as to provide for safety and to contain particles that may be released by the rotation of brush 16. In accordance with the present invention, and as illustrated in FIG. 2, the shroud 36 will have a substantial length so as to cover the brushes 12, 14 and 16 in the manner illustrated in FIG. 3.

Figure 4:
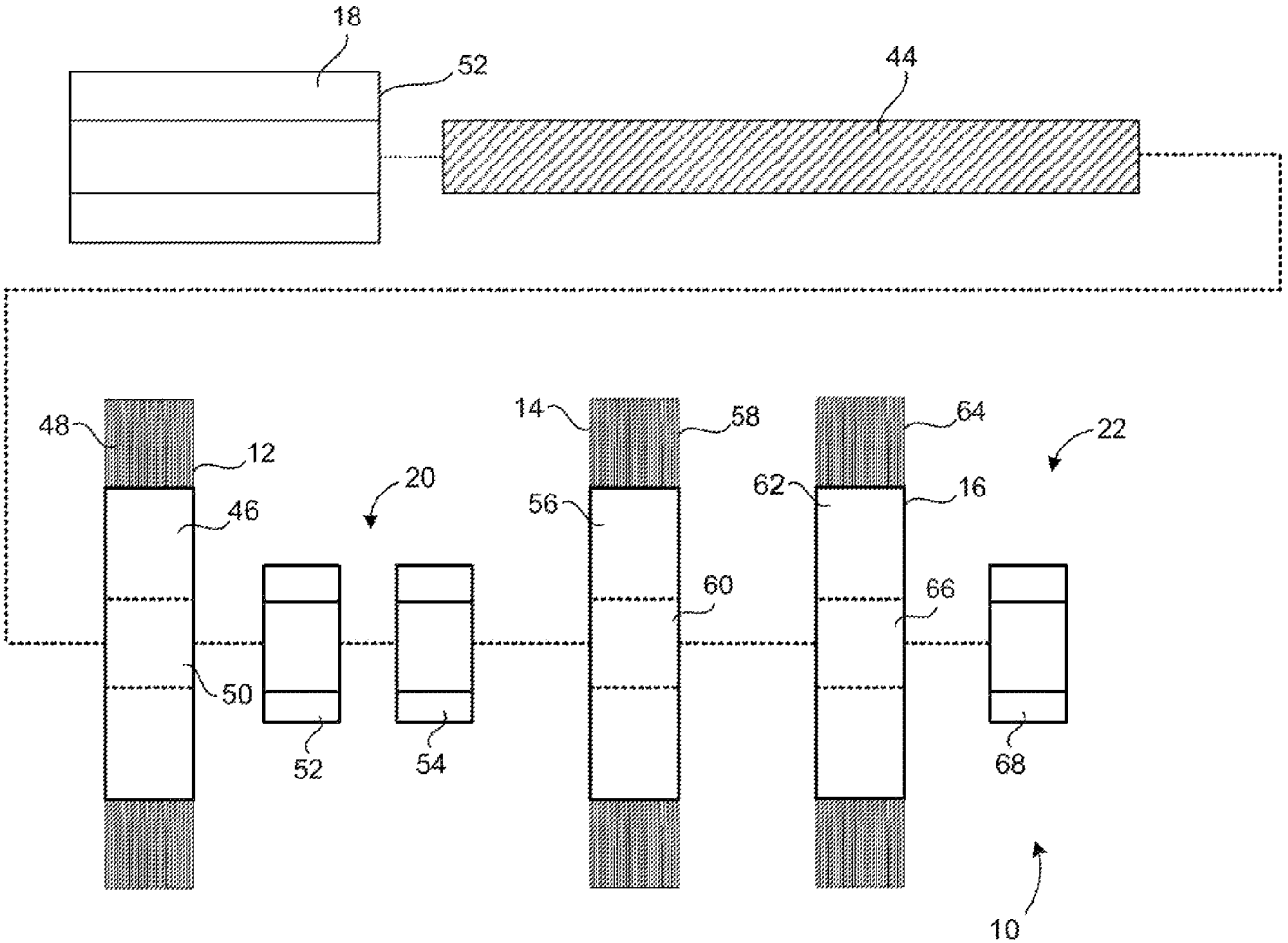
FIG. 4 is an exploded view of the brush assembly as shown in FIG. 1.

FIG. 4 is an exploded view of the brush assembly 10 of the present invention. In particular, it can be seen that there is a threaded rod 44 that is threaded substantially along an entire length thereof. The coupler 18 will be threadedly secured to an end of the rod 44. The coupler 18 is suitable for being releaseably received by the shaft receptacle of the power tool 28. As such, the coupler 18 serves to transfer the rotational motion of the shaft receptacle of the power head 26 and the rotary motion of the threaded rod 44.

The first brush 12 is illustrated in partial cross-section. As can be seen, the first brush 12 includes a core 46 that has bristles 48 extending radially outwardly therefrom. The bristles 48 will extend entirely around the diameter of the first brush 12. The core 46 includes a hole 50 formed centrally therethrough. The hole 50 will pass over the outer diameter of the rod 44 so as to allow the core 46 to be disposed against the end surface 52 of the coupler 18.

The first nut assembly 20 is illustrated as having a first nut 52 and a second nut 54. The first nut 52 is threadedly secured over the threaded rod 44 so as to bear upon the core 46 of the first brush 12. As such, the first brush 12 will be interposed between the end 52 of the coupler 18 and the side of the first nut 52. As a result, the first brush 12 will fixedly secured to the threaded rod 44. The second nut 54 is also threadedly affixed over the threaded rod 44. The second nut 54 will abut the opposite side of the nut 52 from the first brush 12. If necessary, so as to expand the space between the first brush 12 and the second brush 14, washers, or other rings, can be interposed between the first nut 52 and the second nut 54 on the rod 44. As a result, the spacing between the brushes 12 and 14 can be adapted to the width of the weld bead.

The second brush 14 also has a core 56. The brushes 58 (or bristles) will extend radially outwardly of the core 56. The brushes 58 will extend entirely around the diameter of the second brush 14. The core 56 includes a hole 60 formed therethrough. As such, the threaded rod 44 can be placed through the hole 60 so as to allow the second brush 14 to be mounted onto the threaded rod 44.

The third brush 16 is illustrated as having a core 62 with brushes 64 (or bristles) extending radially outwardly therefrom. The core 62 has a hole 66 formed therethrough. As a result, the threaded rod 44 can extend through the hole 66 so as to allow the third brush 16 to be mounted in side-by-side relationship to the second brush 14. If any spacing is desired between the brushes 14 and 16, then washers can be placed over the exterior surface of the rod 44 so as to achieve the requisite spacing.

The second nut assembly 22 includes a third nut 68. The third nut 68 can be threadedly affixed over the threaded exterior surface of the rod 44 so as to bear against the side of the core 62 of the third brush 16. The second brush 14 and the third brush 16 will be interposed between the nuts 54 and 68. As a result, the second brush 14 and the third brush 16 will be fixedly secured to the rod 44.

Within the concept of the present invention, the nut 52 could be welded to the core 46 of the first brush 12. Similarly, the second nut 54 could also be welded to the side of the core 56 of the second brush 14. Additionally, a third nut 68 could be welded to the side of the core 62 of the third brush 16. If it is necessary to replace any of the brushes 12, 14 and 16, it would only necessary to release the respective nuts 52, 54 and 68 from the threaded rod 44.

Figure 5:
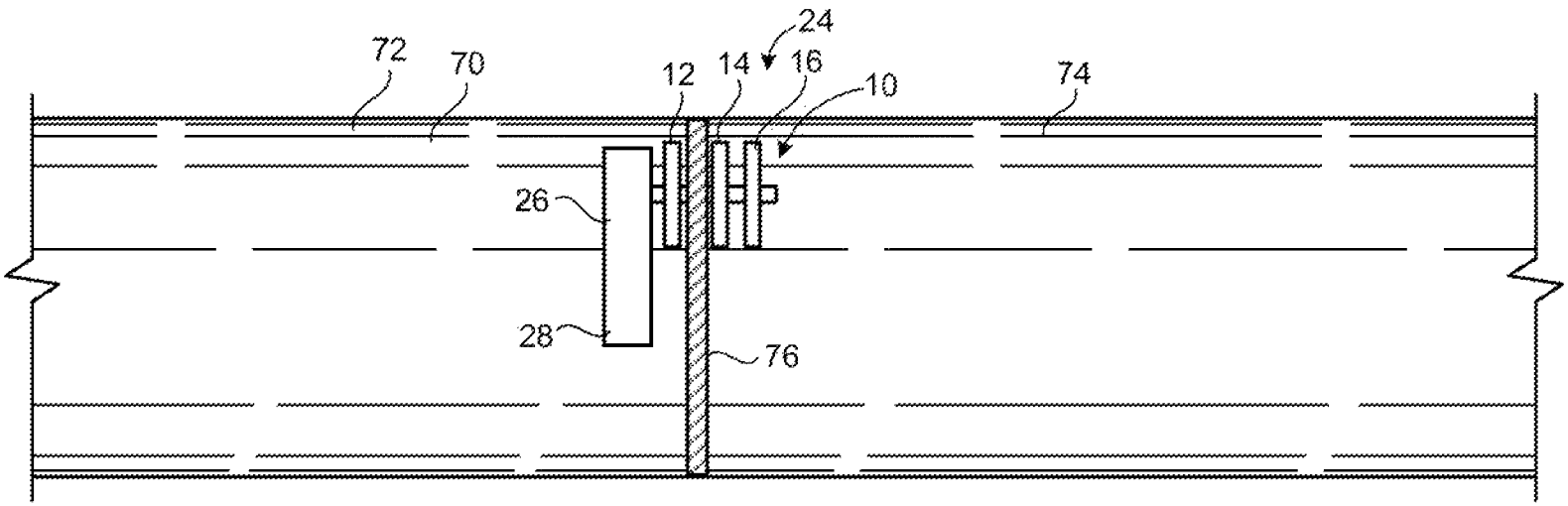
FIG. 5 is an illustration showing the operation of the present invention as used for the dressing of a weld in an area adjacent to a weld bead.

FIG. 5 shows the operation of the apparatus 24 of the present invention. As can be seen, the brush assembly 10 is mounted to the power head 26 of the power tool 28. The power tool 28 is held by the worker in a position adjacent to the outer surface of the pipe assembly 70. The pipe assembly 70 includes a first pipe section 72 and a second pipe section 74. The weld bead 76 will extend around the circumference of the pipe sections 72 and 74.

In FIG. 5, it can be seen that the first brush 12 is spaced from the second brush 14 by a distance substantially equal to or greater than the width of the weld bead 76. When the apparatus 24 is applied to the exterior surface of the pipeline 70, the weld bead 76 will provide a guide for the movement of the brush assembly 10. Since the brushes 12, 14 and 16 are being rotated, the wire brushes will effectively clean the surfaces of the pipe sections 72 and 74 adjacent to the weld bead 76. The power tool 28 can be moved circumferentially around the pipeline 16. The accurate movement of the apparatus 24 is assured by the relationship of the first brush 12 and the second brush 14 as guided by the weld bead 76.

The apparatus 24 of the present invention will be utilized at the time of the grinding and buffing operation. The brush assembly 10 is designed to screw into or onto the threaded power driver head 26 of power tool 28 and position the pair of brushes 14 and 16 on one side of the weld bead 76 and the single brush 12 on the other side of the weld bead 76. The arrangement of the brushes 12 and 14 is such there is a void space therebetween. This open space provides a guide for the buffer brushes to easily follow the weld bead. The brushes 12 and 16, as located on opposite sides of the weld bead 76, clean the edges of the bead 76 with a high degree of cleanliness and accuracy. The top of the welded bead 76 lends itself readily for relatively easy cleaning since it sits in an exposed position and as an elevated impediment such that the buffing brushes can easily clean.

As the cleaning progresses, and the apparatus 24 is moved along the exterior pipe surface. The cleaning process continues until the designated area is thoroughly cleaned. The weld bead 76 is readily cleaned with brush assembly 10 as well as any remaining adjacent area designated for cleaning.

The apparatus 24 is designed to simplify and cut buffing time as well as improving the quality of buffing on the welds and the pipe surface as well as to other metal surfaces for different concurrent procedures. Such procedures would include the inspection of welds, the x-ray of welds, and the coating or painting of welds.

Typically, each of the brushes 12, 14 and 16 will have a virtually identical diameter and a virtually identical width. A very common size of such a brush is six inches in diameter. However, the present invention is applicable to all sizes of brushes. The use of a six-inch brush is only a specific example of the nature of the present invention. Also, and alternatively, the pair of buffer brushes 14 and 16 could be placed adjacent to the power head 26 and the single brush 12 could be placed on the opposite side of the weld bead.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus for dressing weld in an area adjacent a weld bead, the apparatus comprising:

a power head;

a shaft affixed to said power head such that said power head rotates said shaft;

a first brush affixed to said shaft and extending radially outwardly therefrom; and a second brush affixed to said shaft and extending radially outwardly therefrom, said second brush being spaced by a distance greater than a width of the weld bead from said first brush, said shaft comprising:

a rod having a threaded exterior surface;

a coupler threadedly affixed over said exterior surface of said rod, said coupler extending for less than a length of said rod;

a first nut assembly threadedly affixed over said exterior surface of said rod, said first brush being interposed between said coupler and said first nut assembly, said first nut assembly positioned in said space between said first and second brushes; and a second nut assembly threadedly affixed over said exterior surface of said rod, said second nut assembly positioned on a side of said second brush opposite said first nut assembly.

2. The apparatus of claim 1, each of first and second brushes being wire brushes.

3. The apparatus of claim 2, each of said first and second brushes having a core with a hole extending therethrough, said shaft extending through the holes, the core having said wire brushes extending radially outwardly therefrom.

4. The apparatus of claim 1, further comprising:

a third brush affixed to said shaft in side-by-side relationship to said second brush on a side of said second brush opposite said first brush.

5. The apparatus of claim 1, each of said first and second brushes having a substantially equal outer diameter.

6. The apparatus of claim 1, said power head comprising:

a housing;

a motor positioned in said housing; and a shaft connector drivingly connected to said motor, said shaft being releasably received by said shaft connector.

7. The apparatus of claim 6, further comprising:

a shroud affixed to said housing and extending outwardly over said first and second brushes, said shroud having a generally semi-cylindrical shape.

8. The apparatus of claim 1, each of said first and second brushes having a core, said coupler and said first nut assembly bearing against the core of said first brush, said first nut assembly bearing against the core of said second brush.

9. The apparatus of claim 8, said first nut assembly comprising a first nut bearing against the core of said first brush and a second nut bearing against the core of said second brush.

10. The apparatus of claim 9, said second nut assembly comprising a third nut bearing against the core of said second brush on a side opposite said second nut.

11. The apparatus of claim 1, further comprising:

a third brush positioned on said rod in a location adjacent to said second brush on a side opposite said first brush, said first nut assembly bearing against said second brush, said second nut assembly bearing against said third brush.

12. The apparatus of claim 1, said coupler affixed to said power head.

13. A brush assembly for dressing a weld in an area adjacent a weld bead, the brush assembly comprising:

a shaft;

a first brush affixed to said shaft and extending radially outwardly therefrom; and a second brush affixed to said shaft and extending radially outwardly therefrom, said second brush being spaced by a distance greater than a width of the weld bead from said first brush, said shaft comprising:

a rod having a threaded exterior surface;

a coupler threadedly affixed over said exterior surface of said rod, said coupler extending for less than a length of said rod;

a first nut assembly threadedly affixed over said exterior surface of said rod, said first brush being interposed between said coupler and said first nut assembly, said first nut assembly positioned in said space between said first and second brushes; and a second nut assembly threadedly affixed over said exterior surface of said rod, said second nut assembly positioned on a side of said second brush opposite said first nut assembly.

14. The brush assembly of claim 13, each of first and second brushes being wire brushes.

15. The brush assembly of claim 13, further comprising:

a third brush affixed to said shaft in side-by-side relationship to said second brush on a side of said second brush opposite said first brush.

16. The brush assembly of claim 15, each of said first brush and said second brush and said third brush having a substantially equal width and a substantially equal diameter.

17. The brush assembly of claim 14, each of said first and second brushes having a core with a hole extending therethrough, said shaft extending through the holes, the core having said wire brushes extending radially outwardly therefrom.

18. The brush assembly of claim 13, each of said first and second brushes having a core, said coupler and said first nut assembly bearing against the core of said first brush, said first nut assembly bearing against the core of said second brush.

* * * * *